US007384328B2

(12) United States Patent
Panfili

(10) Patent No.: US 7,384,328 B2
(45) Date of Patent: Jun. 10, 2008

(54) SANDING DEVICE, AND SANDING ASSEMBLY INCLUDING THE SAME

(75) Inventor: Luigi Panfili, Berthierville (CA)

(73) Assignee: A. Richard S.E.N.C., Berthierville (CA)

( * ) Notice: Subject to any disclaimer, the term of this patent is extended or adjusted under 35 U.S.C. 154(b) by 0 days.

(21) Appl. No.: 11/608,603

(22) Filed: Dec. 8, 2006

(65) Prior Publication Data

US 2007/0141968 A1 Jun. 21, 2007

Related U.S. Application Data

(60) Provisional application No. 60/748,167, filed on Dec. 8, 2005.

(30) Foreign Application Priority Data

Dec. 8, 2005 (CA) ..... 2529354

(51) Int. Cl.
*B24B 23/00* (2006.01)

(52) U.S. Cl. ..... 451/344; 451/354; 451/456

(58) Field of Classification Search ..... 451/344, 451/350, 354, 456, 523, 524
See application file for complete search history.

(56) References Cited

U.S. PATENT DOCUMENTS

| | | | | |
|---|---|---|---|---|
| 3,160,995 | A | 12/1964 | Danuski, Jr. | |
| 4,062,152 | A * | 12/1977 | Mehrer | 451/344 |
| D258,043 | S | 1/1981 | Gregoire et al. | |
| D263,277 | S | 3/1982 | Gregoire et al. | |
| 4,320,601 | A | 3/1982 | Haney | |
| 4,779,385 | A | 10/1988 | Reiter | |
| 4,937,984 | A | 7/1990 | Taranto | |
| 4,964,243 | A | 10/1990 | Reiter | |
| 5,007,206 | A | 4/1991 | Paterson | |
| 5,036,627 | A * | 8/1991 | Walters | 451/354 |
| 5,056,268 | A | 10/1991 | Wolff et al. | |
| 5,123,216 | A | 6/1992 | Kloss et al. | |
| 5,193,313 | A | 3/1993 | Sanchez et al. | |
| 5,239,783 | A * | 8/1993 | Matechuk | 451/354 |
| 5,245,797 | A | 9/1993 | Milkie | |
| D343,104 | S | 1/1994 | Hoshino | |
| D344,003 | S | 2/1994 | Milkie | |

(Continued)

*Primary Examiner*—Eileen P. Morgan
(74) *Attorney, Agent, or Firm*—Darby & Darby PC

(57) ABSTRACT

A sanding device including a base plate, an evacuating tube, an articulated joint, and a sealing member. The base plate has a sanding surface and an opposite supporting surface, with an orifice extending therethrough for allowing the passage of particles sanded by the sanding surface. The evacuating tube has an inlet operatively connected to the supporting surface of the base plate, the inlet being positioned about the orifice of the base plate for receiving particles sanded by the sanding surface of the base plate, through the orifice thereof. The evacuating tube also has an outlet configured for operatively connecting to a vacuum system for evacuating sanded particles from the sanding surface through the orifice of the base plate via a suction effect provided by the vacuum system. The articulated joint is configured for operatively connecting the inlet of the evacuating tube to the supporting surface of the base plate, and has at least one pivot axis for enabling the evacuating tube to be articulated with respect to the base plate along various operating angles. The sealing member is operatively mounted onto the base plate for sealingly interconnecting the orifice of the base plate to the inlet of the evacuating tube. Also described is a sanding assembly provided with the above-mentioned sanding device.

17 Claims, 12 Drawing Sheets

U.S. PATENT DOCUMENTS 5,313,746 A 5/1994 Zarriello
5,319,889 A 6/1994 Rudolf et al.
D354,666 S 1/1995 Kriabel
5,398,454 A 3/1995 Berner et al.
5,398,457 A 3/1995 Updegrave et al.
5,470,272 A * 11/1995 Kikuchi et al. ..... 451/344
5,482,499 A 1/1996 Satoh et al.
5,527,212 A * 6/1996 Bowen et al. ..... 451/456
D371,948 S 7/1996 Liu
5,533,925 A 7/1996 Sato et al.
5,558,569 A 9/1996 Lee et al.
5,605,500 A 2/1997 Matechuk et al.
5,624,305 A * 4/1997 Brown ..... 451/354
D387,962 S 12/1997 Apolinski et al.
5,709,595 A 1/1998 Bergner et al.
D392,860 S 3/1998 Brown
5,833,524 A 11/1998 Satoh et al.
D404,273 S 1/1999 Somers
D414,395 S 9/1999 Panfili et al.
5,967,886 A 10/1999 Wuensch et al.
6,004,194 A 12/1999 Hild et al.
6,099,397 A 8/2000 Wurst et al.
D431,993 S 10/2000 Panfili et al.
D435,408 S 12/2000 Panfili et al.
6,179,696 B1 1/2001 Duffy et al.
6,257,969 B1 7/2001 Bosten et al.
D459,965 S 7/2002 Pretzell et al.
D463,639 S 9/2002 Panfili et al.
D474,389 S 5/2003 Panfili et al.
6,629,331 B2 10/2003 Panfili et al.
6,705,931 B2 3/2004 Moolenaar et al.
6,719,620 B1 4/2004 Panfili et al.
6,726,868 B1 4/2004 Panfili et al.
6,742,215 B2 6/2004 Panfili et al.
D494,434 S 8/2004 Sun et al.
6,775,912 B2 8/2004 Panfili et al.
6,860,799 B2 * 3/2005 Loveless ..... 451/354
D504,602 S 5/2005 Aglassinger et al.
D511,954 S 11/2005 Heun et al.
7,033,259 B1 4/2006 Seasholtz et al.
2001/0051501 A1 12/2001 Pellegrin
2004/0192180 A1 9/2004 Bosten et al.

* cited by examiner

SANDING DEVICE, AND SANDING ASSEMBLY INCLUDING THE SAME

The present application claims priority of U.S. provisional patent application No. 60/748,167 dated Dec. 8, 2005 and of Canadian patent application No. 2,529,354 dated Dec. 8, 2005, the contents of which are both incorporated herein by reference.

FIELD OF THE INVENTION

The present invention relates to a sanding device, hereinafter referred to also as a "sanding tool". More particularly, in its preferred intended use, the present invention relates to a sanding tool such as the ones used with vacuums and the like, and also relates to a vacuum/sanding assembly provided with such a sanding tool, and to a method of operating associated thereto.

BACKGROUND OF THE INVENTION

Known in the art are various tools used for sanding applications and other related tasks.

The Assignee of the present application has developed several of such products, some of which are described in the following U.S. Pat. Nos. and industrial designs: D258,043; D263,277; D414,395; D431,993; D435,408; D463,639; D474,389; U.S. Pat. Nos. 6,629,331; 6,719,620; 6,726,868; 6,742,215; and 6,775,912, the contents of which are incorporated here by reference.

Also known to the Applicant are the following U.S. Pat. Nos. , patent application and industrial designs which describe sanding tools and the like: U.S. Pat. Nos. 3,160,995; 5,056,268; 5,123,216; 5,313,746; 5,319,889; 5,398,454; 5,398,457; 5,470,272; 5,482,499; 5,533,925; 5,558,569; 5,605,500; 5,709,595; 5,833,524; 5,967,886; 6,004,194; 6,099,397; 6,179,696 B1; 6,257,969 B1; 6,705,931 B2; Des. 343,104; Des. 387,962; Des. 404,273; D459,965 S; D494,434 S; D504,602 S; D511,954 S; and 2004/0192180 A1.

Indeed, sanding tools are very well known in the art. A typical sanding tool usually comprises a handle for manual operation of the tool and a working or operating surface onto which a sandpaper (or a sanding meshing) is mounted and rested so as to be able to carry out sanding applications by passing the sandpaper-covered operating surface over the area to be sanded.

Also known in the art are the fastening devices which are commonly used to removably mount a sandpaper onto such a sanding tool. Indeed, a typical fastening device generally consists of a pin projecting from a rear portion of the sanding tool onto which a clamping plate is pivotally mounted. A portion of the sandpaper is generally clamped between the rear portion and the clamping plate and this is generally achieved by urging the plate against the rear portion of the sanding tool by means of a nut threadedly engageable onto the pin and rotated thereabout so as to bias the clamping plate against the rear portion. The nut is usually provided with a pair of projections which are commonly known as "rabbit ears" and which are used to facilitate the rotation of the nut about the threaded pin with the fingers of an operator of the tool.

A major problem associated with the above-mentioned type of fastening device is that several turns of the nut about the pin are generally required to provide the necessary clearance to replace a worn-out sandpaper by a new sandpaper, and this is known to be very time-consuming and very strenuous on one's hands, particularly the fingers. Furthermore, usually two hands are required to carry out such an operation, causing an operator to cease any intermediate activities and having to direct his or her attention onto the sandpaper replacement operation. Another problem associated with the above-mentioned type of sanding tool is that if it is inadvertently flipped-over, when sanding, against the area being worked on, which is often drywall or plaster thereon, then the projections of the "rabbit ears" of the nuts of the fastening devices of the sanding tool will often cause substantial markings onto the area being worked on, which is very disadvantageous for obvious reasons. Indeed, such damages are very often tedious and time-consuming to repair and such damages also prevent an optimal finish from being obtained.

Furthermore, it is also known that most conventional sanding devices are not considered optimal for certain applications, particularly for sanding corners, side edges and the like.

Hence, in light of the aforementioned, there is a need for an improved sanding device which would be able to overcome and/or remedy some of the aforementioned prior art problems.

SUMMARY OF THE INVENTION

An object of the present invention is to provide a sanding device which, by virtue of its design and components, satisfies some of the above-mentioned needs and which is thus an improvement over other related sanding devices and/or methods known in the prior art.

In accordance with the present invention, the above object is achieved, as will be easily understood from the present description, with a sanding device such as the one briefly described herein and such as the one exemplified in the accompanying drawings.

More particularly, according to the present invention, there is provided a sanding device comprising:

- a base plate having a sanding surface and an opposite supporting surface, the base plate also having an orifice extending through the base plate, from the sanding surface to the supporting surface thereof, for allowing the passage of particles sanded by the sanding surface into said orifice;
- an evacuating tube having an inlet operatively connected to the supporting surface of the base plate, the inlet being positioned about the orifice of the base plate for receiving particles sanded by the sanding surface of the base plate, through the orifice thereof, the evacuating tube also having an outlet configured for operatively connecting to a vacuum system for evacuating sanded particles from the sanding surface through the orifice of the base plate via a suction effect provided by the vacuum system;
- an articulated joint for operatively connecting the inlet of the evacuating tube to the supporting surface of the base plate, the articulated joint having at least one pivot axis for enabling the evacuating tube to be articulated with respect to the base plate along various operating angles; and
- a sealing member operatively mounted onto the base plate for sealingly interconnecting the orifice of the base plate to the inlet of the evacuating tube.

According to another aspect of the invention, there is also a sanding assembly for sanding and evacuating particles, the sanding assembly comprising:

- a vacuum system; and sanding device, the sanding device comprising:

a base plate having a sanding surface and an opposite supporting surface, the base plate also having an orifice extending through the base plate, from the sanding surface to the supporting surface thereof, for allowing the passage of particles sanded by the sanding surface into said orifice;

an evacuating tube having an inlet operatively connected to the supporting surface of the base plate, the inlet being positioned about the orifice of the base plate for receiving particles sanded by the sanding surface of the base plate, through the orifice thereof, the evacuating tube also having an outlet connected to the vacuum system for evacuating sanded particles from the sanding surface through the orifice of the base plate via a suction effect provided by the vacuum system;

an articulated joint for operatively connecting the inlet of the evacuating tube to the supporting surface of the base plate, the articulated joint having at least one pivot axis for enabling the evacuating tube to be articulated with respect to the base plate along various operating angles; and a sealing member operatively mounted onto the base plate for sealingly interconnecting the orifice of the base plate to the inlet of the evacuating tube so as to increase thereinbetween the suction effect provided by the vacuum system According to yet another aspect of the invention, there is also provided a method of operating the above-mentioned sanding device and/or assembly.

According to yet another aspect of the invention, there is also provided a method of securing/mounting the above-mentioned sanding device onto a vacuum or sanding assembly.

According to yet another aspect of the invention, there is also provided a kit for assembling the above-mentioned sanding device and/or assembly.

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
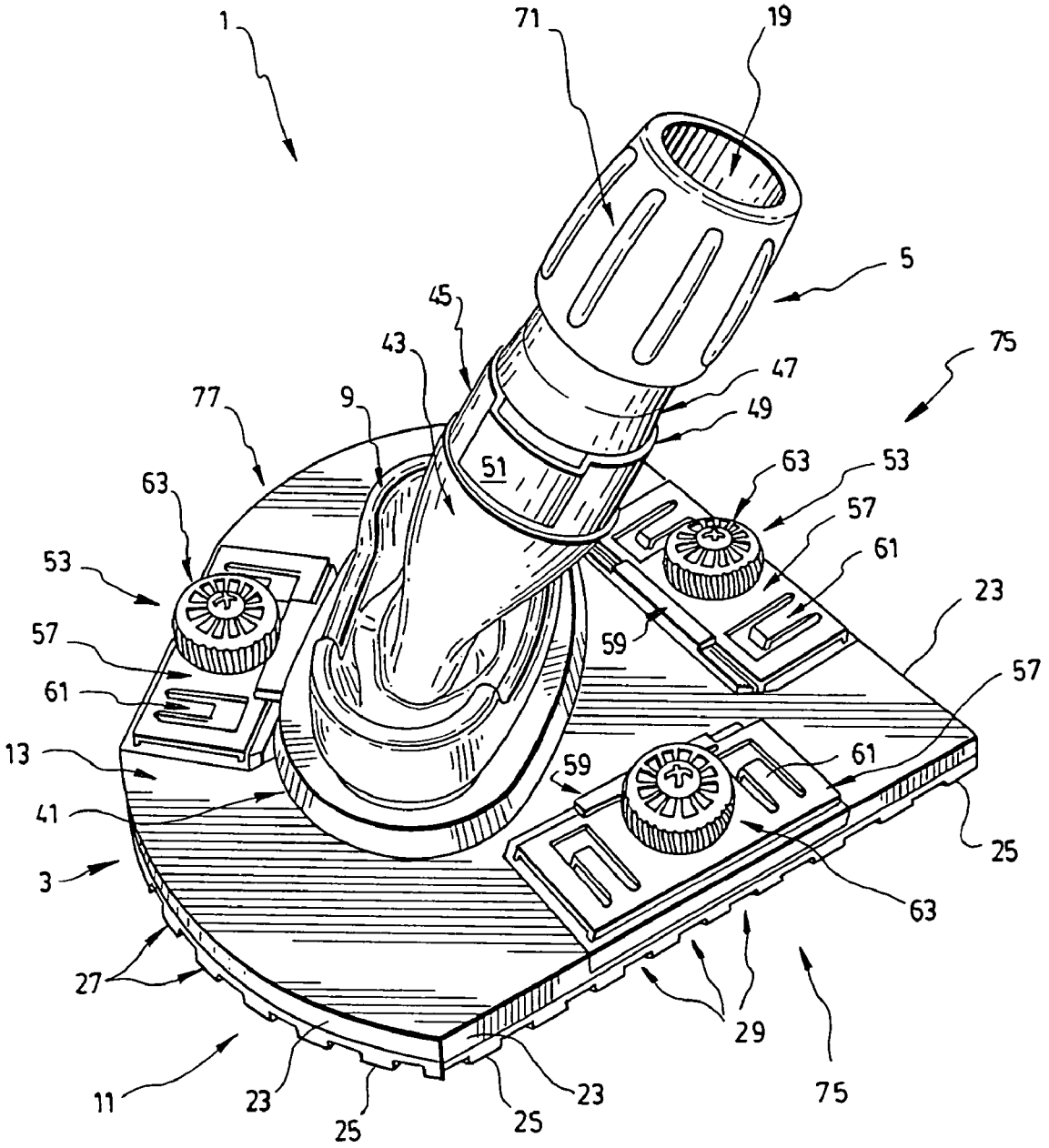
FIG. 1 is a top perspective view of a sanding device according to a preferred embodiment of the present invention, the sanding device being shown in a given configuration.
Figure 2:
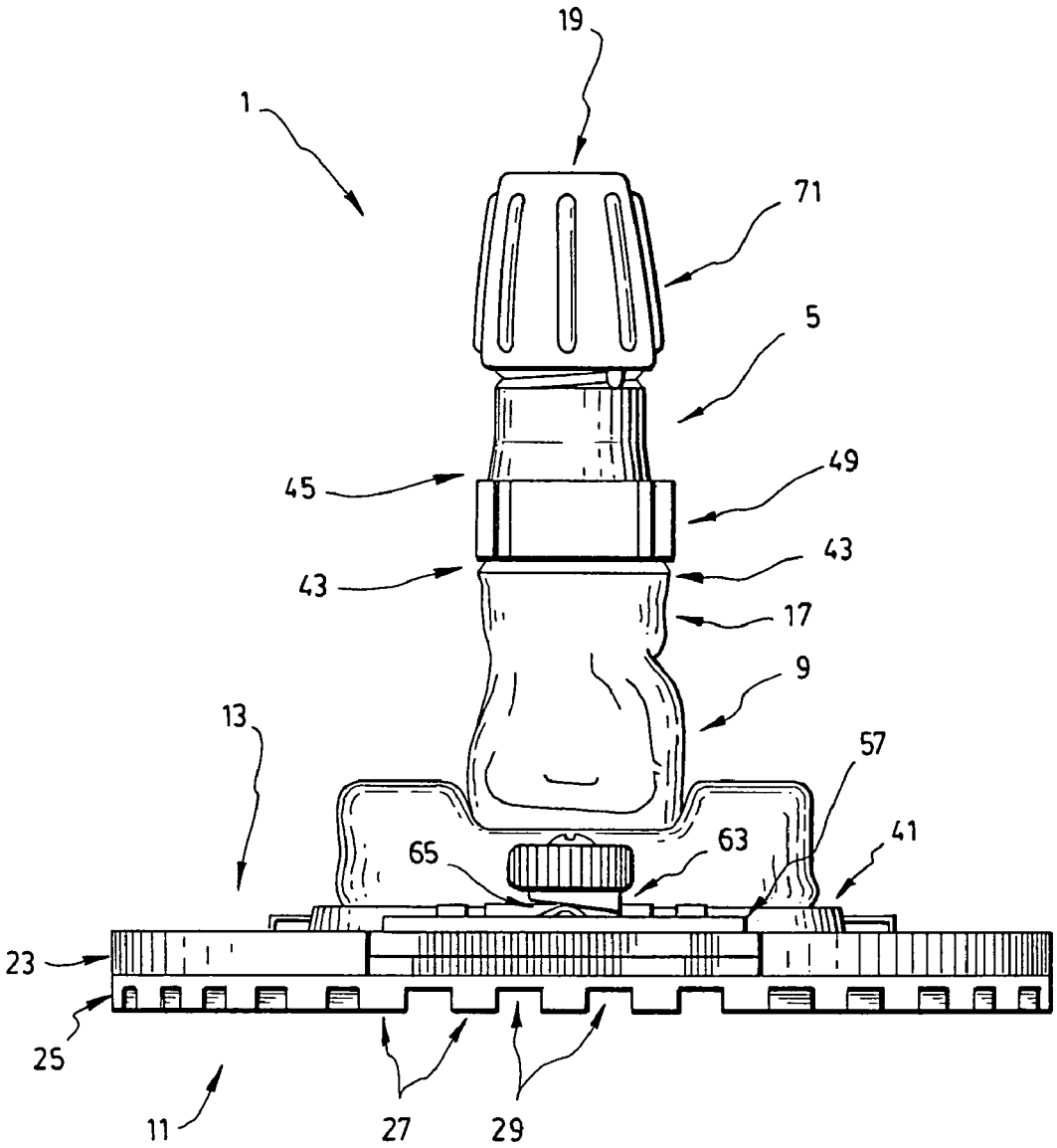
FIG. 2 is a front elevational view of what is shown in FIG. 1, the sanding device being shown in another configuration.
Figure 3:
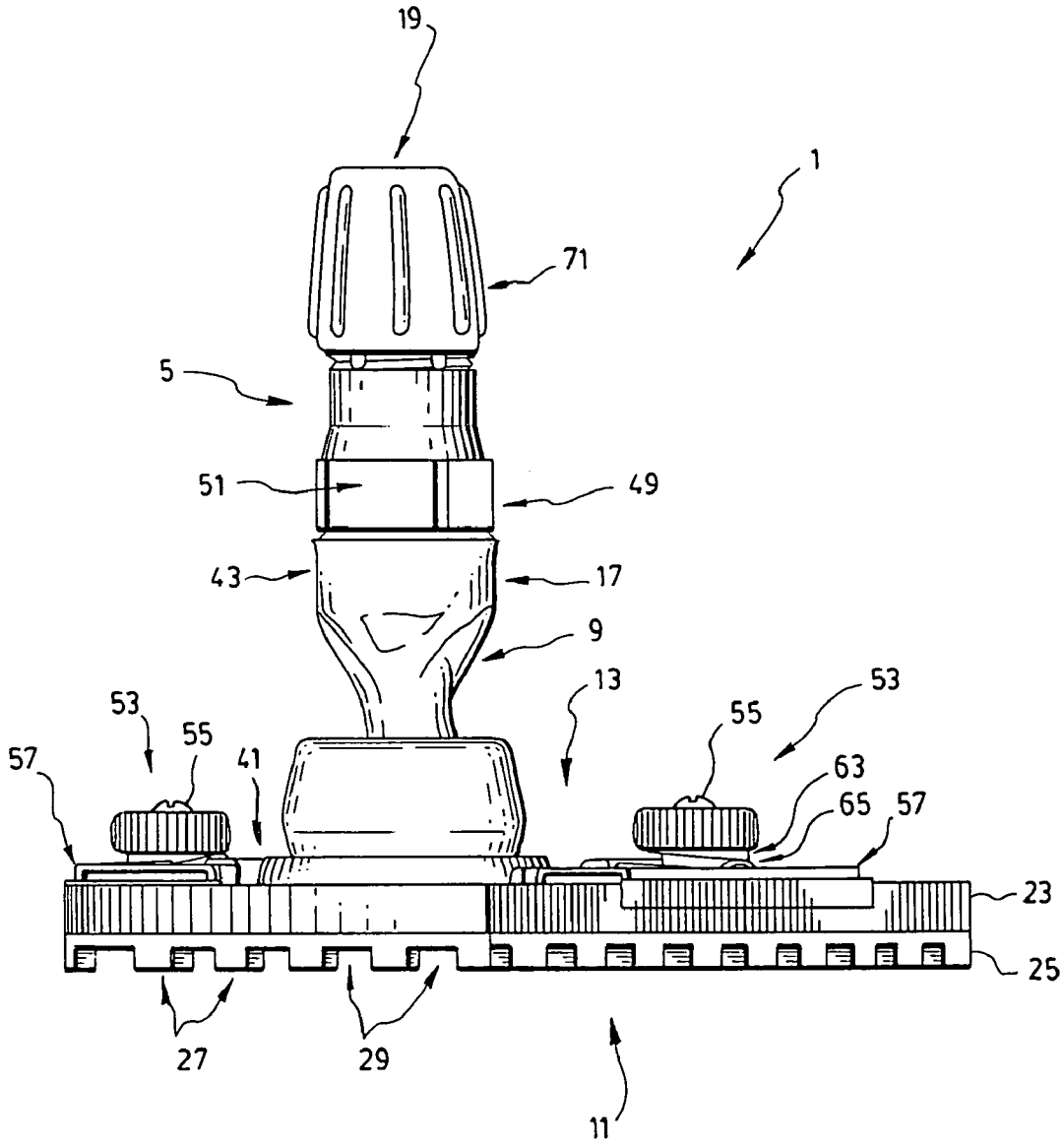
FIG. 3 is a left elevational side view of what is shown in FIG. 2.
Figure 4:
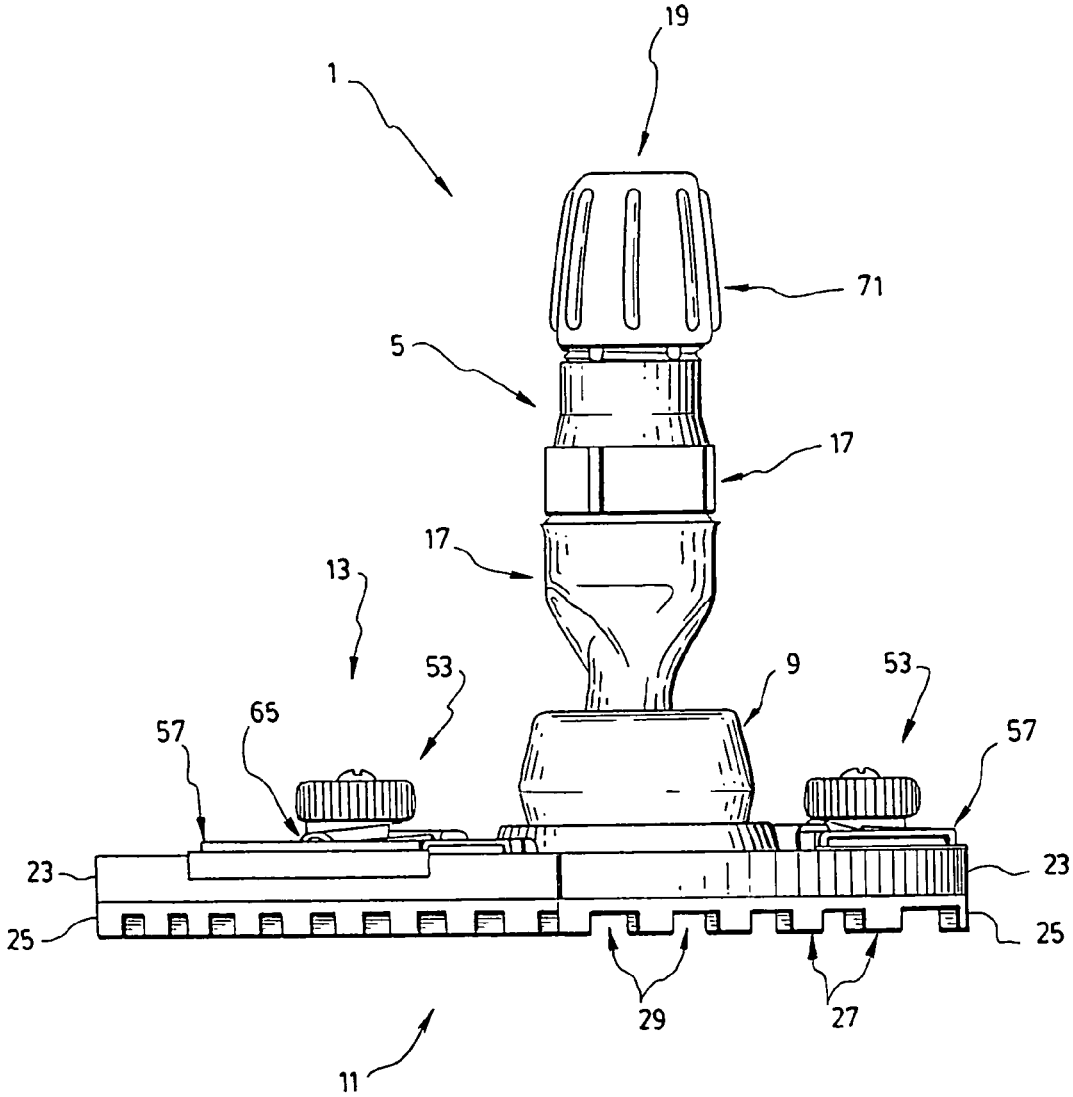
FIG. 4 is a right elevational side view of what is shown in FIG. 2.
Figure 5:
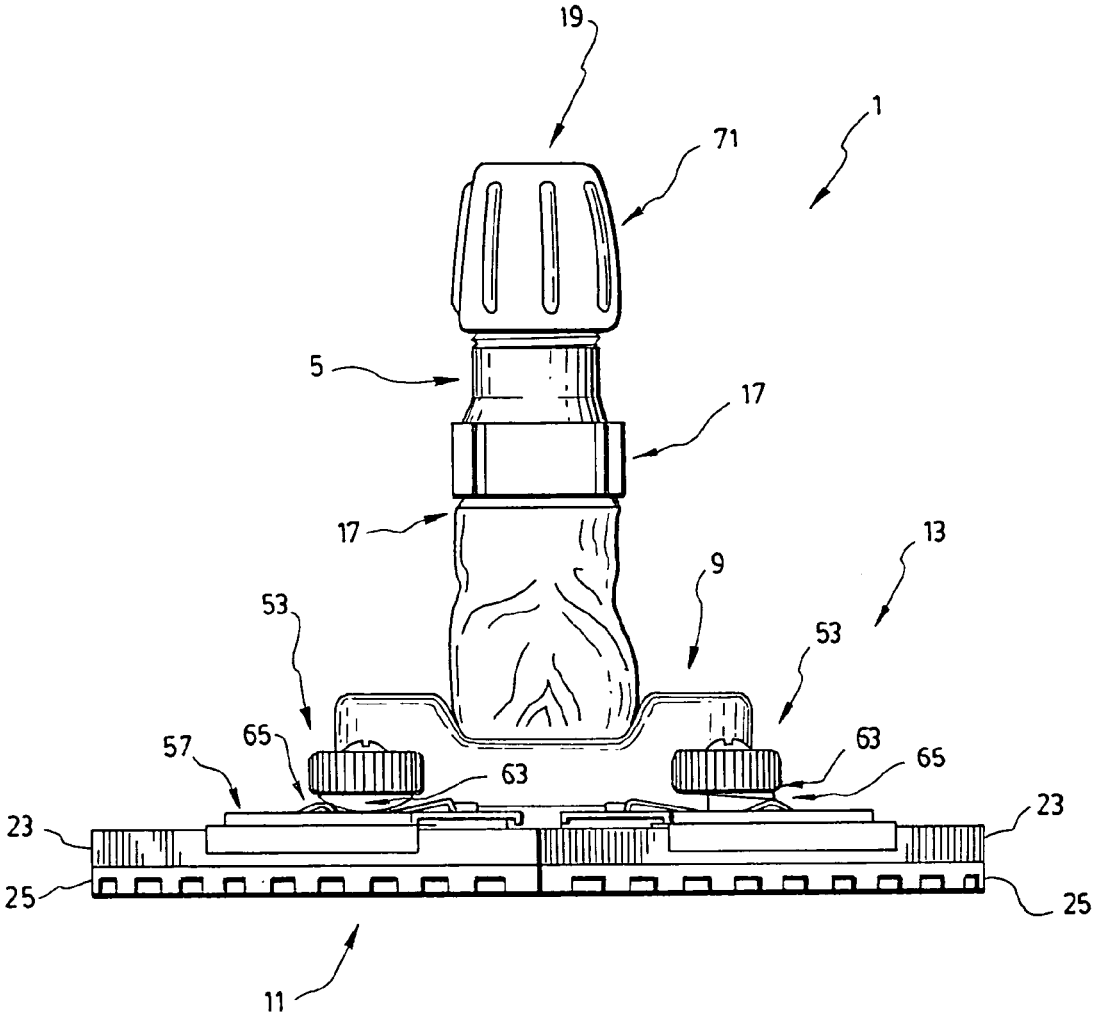
FIG. 5 is a rear elevational view of what is shown in FIG. 2.

In the following description, the same numerical references refer to similar elements. The embodiments, geometrical configurations, materials mentioned and dimensions shown in the figures are preferred, for exemplification purposes only.

Moreover, although the present invention was primarily designed for use with a sanding paper/meshing for carrying out sanding applications, preferably in conjunction with a vacuum system and/or the like, it may be used with other objects and/or in other types of applications, as apparent to a person skilled in the art. For this reason, expressions such as "sanding", "paper", "meshing", "vacuum", etc., used herein should not be taken so as to limit the scope of the present invention and include all other kinds of objects and/or applications with which the present invention could be used and may be useful.

Moreover, in the context of the present invention, the expressions "tool", "device", "system", "sander", "unit", "assembly", as well as any other equivalent expressions and/or compound words thereof, may be used interchangeably. The same applies for any other mutually equivalent expressions, such as "paper" and "meshing" for example, as well as "base", "plate" and "handle", or even "plate" and "blade", as also apparent to a person skilled in the art.

In addition, although the preferred embodiments of the present invention as illustrated in the accompanying drawings comprise various components, and although the preferred embodiments of the sanding device 1 and corresponding parts as shown consist of certain geometrical configurations as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the sanding device 1 and corresponding parts according to the present invention, as will be briefly explained herein and as can be easily inferred herefrom by a person skilled in the art, without departing from the scope of the present invention.

Broadly described, and as better exemplified in the accompanying drawings, the present invention relates to a sanding device 1 with improved shape and features enabling for better, easier and more convenient sanding applications.

According to the present invention, the sanding device 1 generally comprises a base plate 3, an evacuating tube 5, an articulated joint 7 and a sealing member 9, as illustrated in the accompanying drawings.

As better shown in FIGS. 1 and 9-11, the base plate 3 has a sanding surface 11 and an opposite supporting surface 13, the base plate 3 also having an orifice 15 extending through the base plate 3, from the sanding surface 11 to the supporting surface 13 thereof, for allowing the passage of particles sanded by the sanding surface 11 into said orifice 15, as can be easily understood by a person skilled in the art.

The evacuating tube 5 has an inlet 17 operatively connected to the supporting surface 13 of the base plate 3, the inlet 17 being positioned about (close to, in proximity thereof, facing the, adjacent to, etc., as can be easily understood by a person skilled in the art) the orifice 15 of the base plate 3 for receiving particles sanded by the sanding surface 11 of the base plate 3, through the orifice 15 thereof. The evacuating tube 5 also has an outlet 19 configured for operatively connecting to a vacuum system for evacuating sanded particles from the sanding surface 11 through the orifice 15 of the base plate 3 via a suction effect provided by the vacuum system, as can also be easily understood by a person skilled in the art. Indeed, vacuum systems are well known in the art, and thus do not need to be explained in greater detail in the context of the present description.

Figure 9:
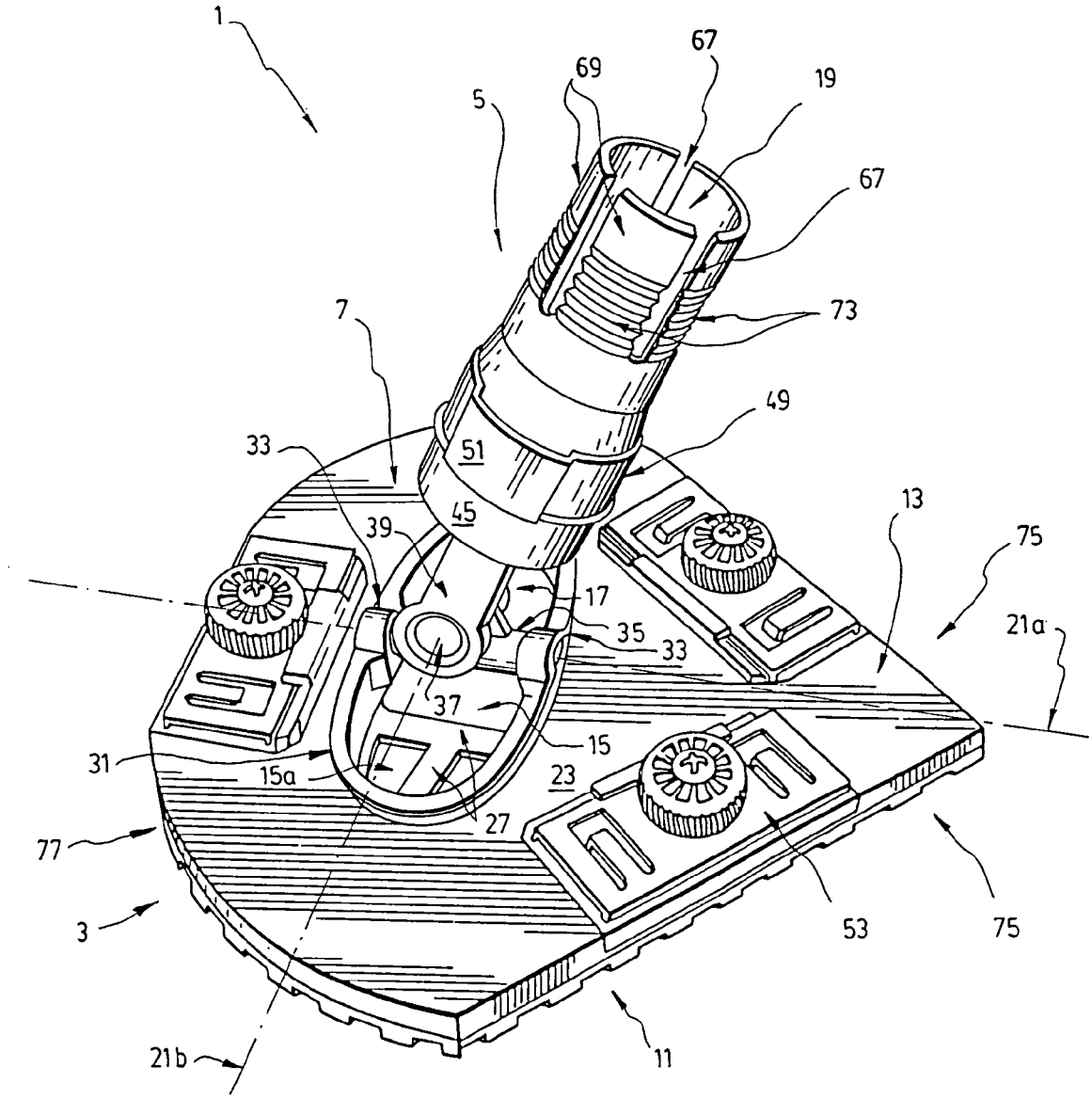
FIG. 9 is another top perspective view of the sanding device shown in FIG. 1, the sanding device being now shown deprived of its sealing member and choking collar so as to better illustrate the articulated joint and choking tongues respectively of the sanding device according to preferred embodiments of the present invention.
Figure 10:
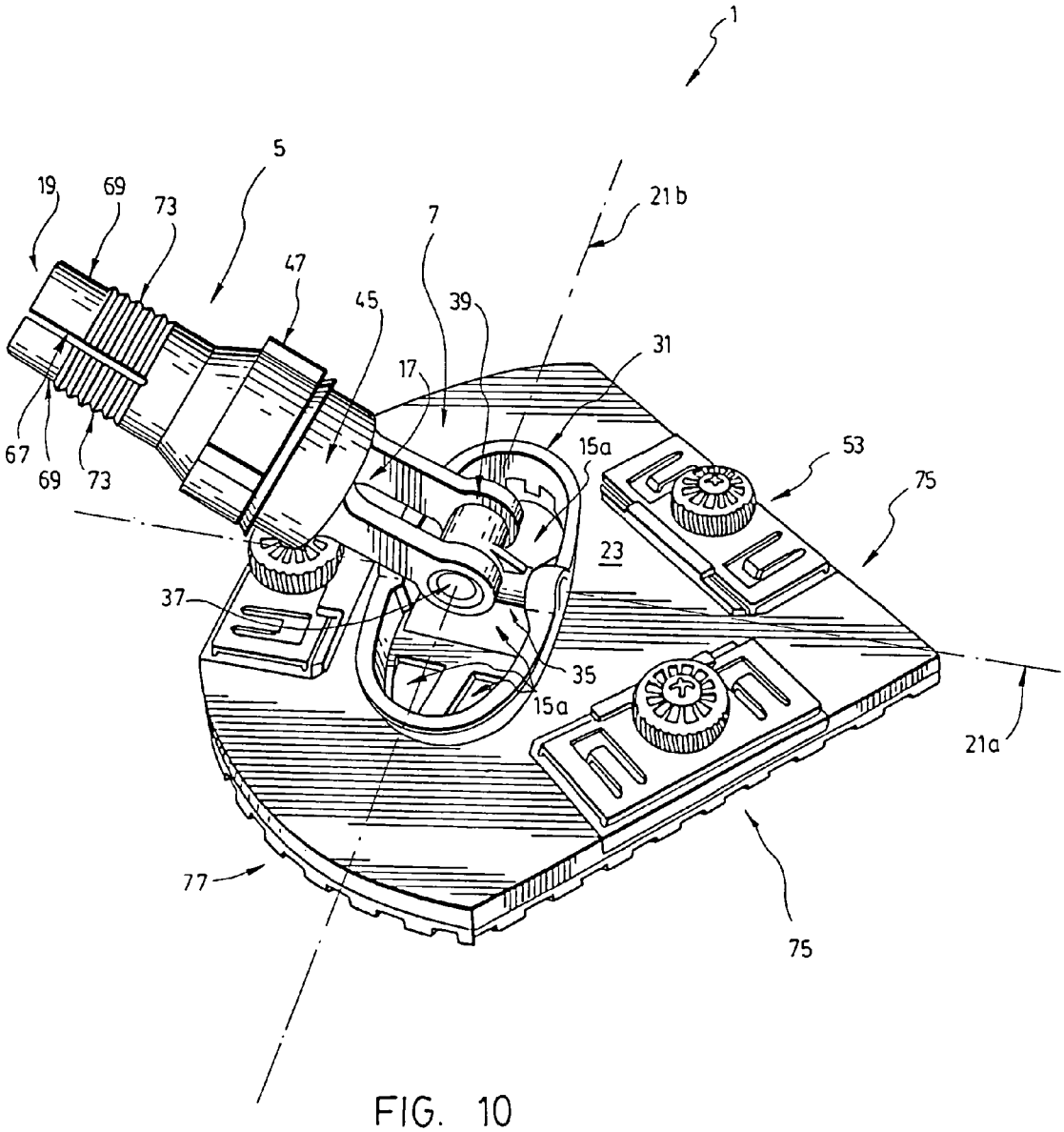
FIG. 10 is another top perspective view of what is shown in FIG. 9, the sanding device being now shown with its evacuating tube having been pivoted about a first pivot axis.
Figure 11:
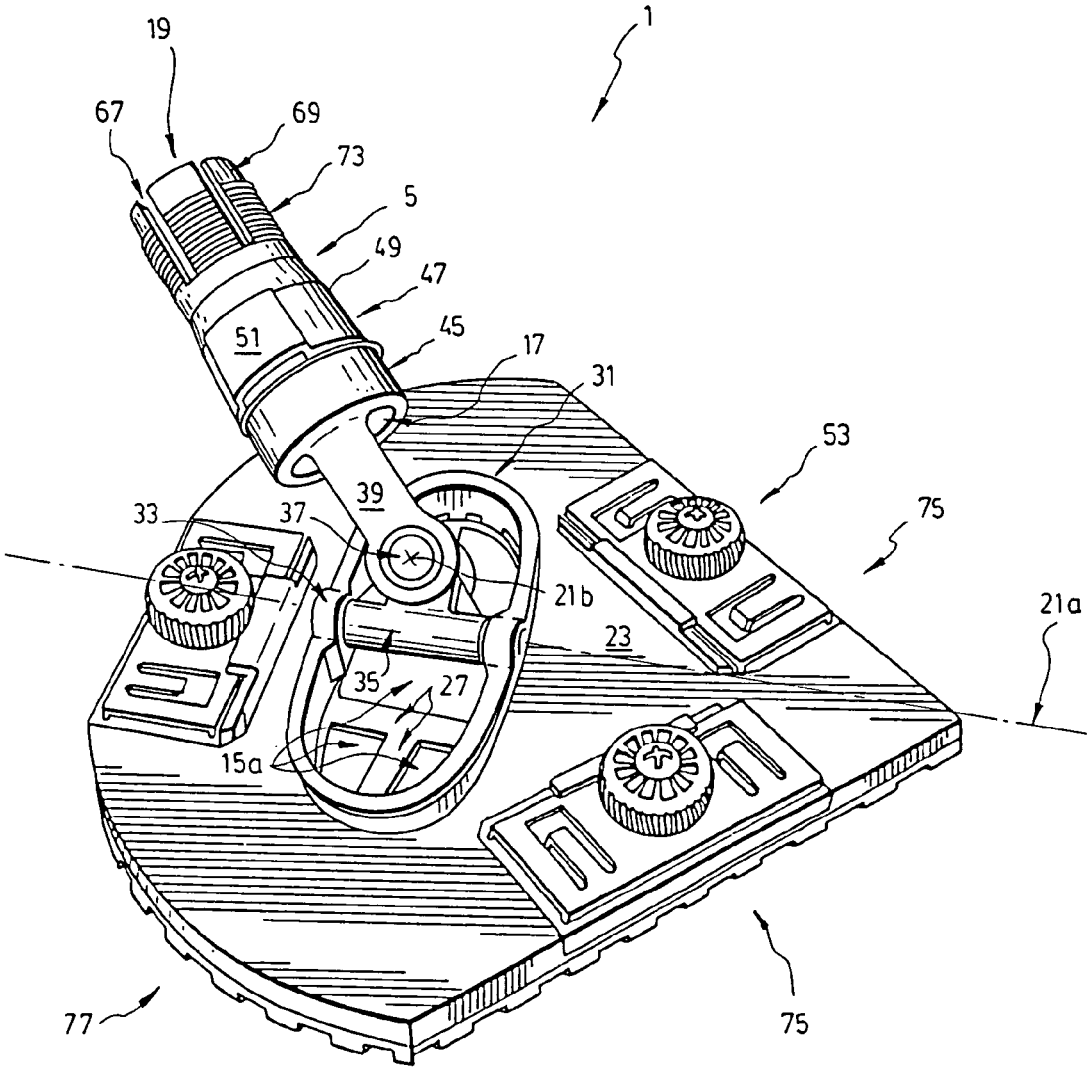
FIG. 11 is another top perspective view of what is shown in FIG. 10, the sanding device being now shown with its evacuating tube being further pivoted about a second pivot axis.

The articulated joint 7 is configured for operatively connecting the inlet 17 of the evacuating tube 5 to the supporting surface 13 of the base plate 3, the articulated joint 7 having at least one pivot axis 21 for enabling the evacuating tube 5 to be articulated with respect to the base plate 3 along various operating angles, as can be easily understood by a person skilled in the art when referring to FIGS. 9-11.

Figure 12:
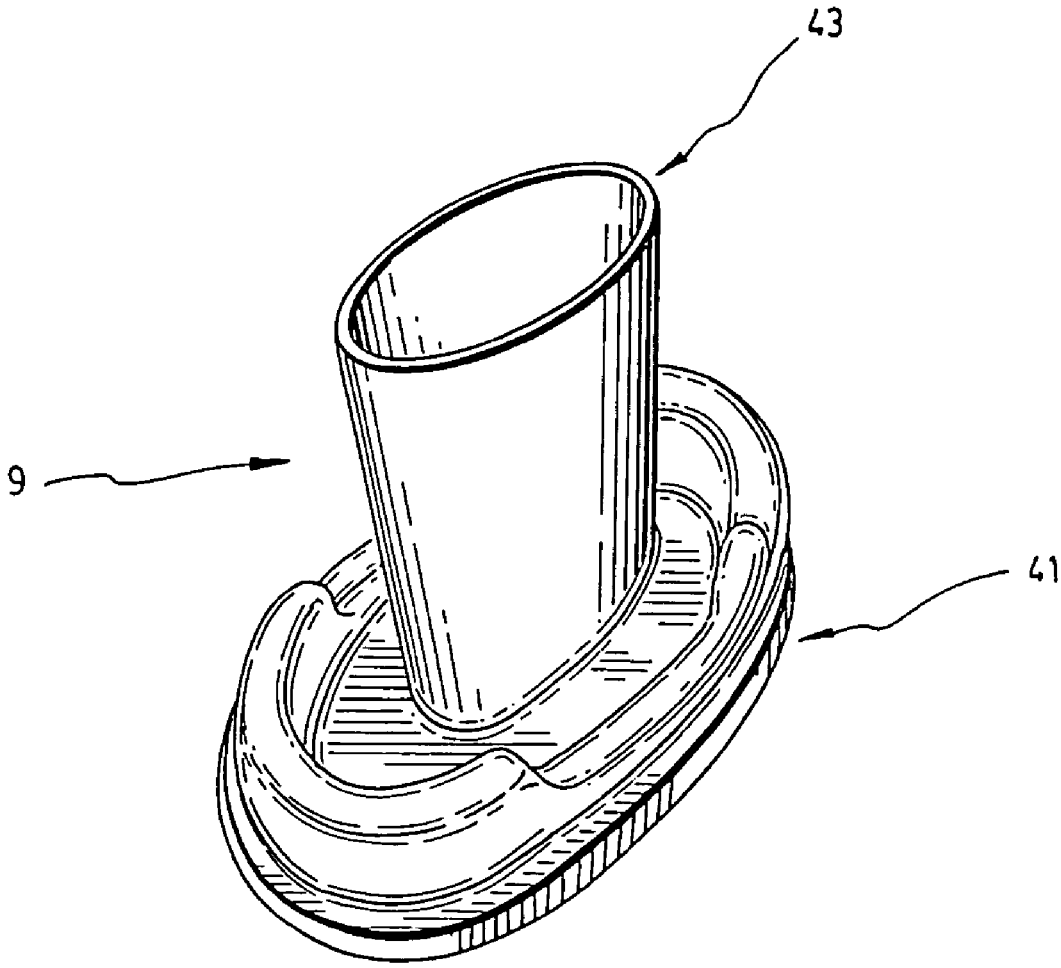
FIG. 12 is a top perspective view of a sealing member according to a preferred embodiment of the present invention.

The sealing member 9 is operatively mounted onto the base plate 3 for sealingly interconnecting the orifice 15 of the base plate 3 to the inlet 17 of the evacuating tube 5, as can be easily understood when contrasting FIGS. 9-11 with FIG. 1, a perspective view of a sealing member 9 according to a preferred embodiment of the present invention being exemplified in FIG. 12.

Preferably, the base plate 3 comprises a substantially rigid support plate 23, and an underlying padding 25 affixed to a bottom surface of the support plate 23, the support plate 23 and the underlying padding 25 being complementary in shape to one another and defining the orifice 15 of the base plate 3, as can be easily understood when referring to FIGS. 1 and 6-11.

Preferably also, the underlying padding 25 has an operating surface for carrying a sanding application with the sanding device 1, the operating surface of the underlying padding 25 being provided with a plurality of ribs 27 protruding from said operating surface and defining a plurality of channels 29 converging substantially towards the orifice 15 of the base plate 3 for directing sanded particles on the operating surface towards said orifice 15, as can be easily understood by a person skilled in the art when referring to FIGS. 7-11.

Preferably also, at least one of said ribs 27 extends over the orifice 15 of the base plate 3 in order to divide said orifice into at least one sub-orifice 15*a*, and the support plate 23 and corresponding underlying padding 25 are shaped accordingly for supporting said at least one of said ribs 27, as also better shown in FIGS. 7-11.

Preferably also, the support plate 23 is made of a substantially rigid elastomeric material, whereas the underlying padding 25 is preferably made of a softer and rubber-like material. However, it is worth mentioning that several other types of materials can be used for the base plate 3 and corresponding constituents thereof, namely support plate 23 and underlying padding 25, depending on the particular applications for which the sanding device 1 is intended for, as apparent to a person skilled in the art.

Preferably also, and as better shown in FIGS. 9-11, the support plate 23 of the base plate 3 is provided with a rim 31 projecting from an upper surface of said support plate 23 and extending about a periphery of the orifice 15 of the base plate 3, the rim 31 comprising a pair of opposite supports 33 for supporting a first hinge 35 of the articulated joint 7, said first hinge 35 being rigidly connected to the inlet 17 of the evacuating tube 5 and being pivotable with respect to said supports 33 of the rim 31 along a first pivot axis 21*a*. Preferably also, the first hinge 35 of the articulated joint 7 comprises a support 37 for supporting a second hinge 39 of the articulated joint 7, said second hinge 39 being pivotable with respect to the supports 33 of the first hinge 35 along a second pivot axis 21*b*.

Thus, it may now be better appreciated that this preferred embodiment of the articulated joint 7 is not only easy and cost-effective to assemble, but also enables the base plate 3 to be tilted and operated with respect to the evacuating tube 5 along different operating angles, which is very advantageous, for obvious reasons known in the art. According to the preferred embodiment of the present invention, the articulated joint 7 is a "universal" joint 7, but several different types of joints 7 can be used with the sanding device 1 without departing from the scope of the present invention, as can be easily understood by a person skilled in the art.

Preferably also, the sealing member 9 has a first end 41 securely mounted about the rim 31 of the support plate 23 and a second end 43 securely mounted about a first peripheral portion 45 of the evacuating tube 5, adjacent to the inlet 17 thereof, as can be easily understood when referring to FIGS. 1 and 9-12.

Preferably also, a second peripheral portion 47 of the evacuating tube 5, adjacent to the first peripheral portion 45 thereof, is provided with a peripheral groove for receiving a ring 49 with stoppers 51 for abutting against the second end 43 of the sealing member 9, as better shown in FIG. 1, and as can be easily understood when referring to FIGS. 9-11.

Preferably also, the support plate 23 has a peripheral surface provided with at least one fastening device 53 for removably clamping at least one corresponding tab of a sanding meshing extendable over the operating surface of the underlying padding of the base plate 3. According to the preferred embodiment of the present invention, as better exemplified in FIG. 1, the sanding device preferably comprises three (3) fastening devices 53.

Preferably also, each fastening device 53 comprises a pin 55 projecting from an upper surface of the support plate 23, and a clamping plate 57 mounted about said pin 55, the clamping plate 57 having a rear edge nested within an abutment ridge 59 and a front edge operable between raised and clamping configuration, the clamping plate 57 being provided with a resilient device 61 for biasing the clamping plate 57 into the raised configuration, and being further provided with a securing cam 63 mounted about the pin 55 and cooperable with an embossment 65 of said pin 55 for selectively securing the clamping plate 57 into the clamping configuration via a rotation of the securing cam 63. These fastening devices 53 are very similar to those described in U.S. Pat. No. 6,719,620 B1 belonging to the Assignee of the present application.

Preferably also, and as better shown in FIGS. 9-11, the outlet 19 of the evacuating tube 5 comprises an end shaped and sized for receiving a hose of the vacuum system, said end being provided with longitudinal slits 67 for defining a plurality of choking tongues 69, and the sanding device 1 further comprises a choking collar 71 displaceable about the choking tongues 69 so as to adjustably secure said choking tongues 69 against the hose of the vacuum system when inserted into the end of the outlet 19 of the evacuating tube 5, as can be easily understood by a person skilled in the art when contrasting FIGS. 1 and 9.

Preferably also, and as also better shown in FIGS. 9-11, the choking tongues 69 are provided with outer threading 73 complementary to inner threading of the choking collar 71 so that a rotation of the collar 71 about the end of the evacuating tube 5 displaces the choking collar 71 along the same for adjustably constricting the choking tongues 69 against one another. It is worth mentioning however that other suitable means could be used for properly securing the outlet of the evacuating tube 5 to a corresponding hose of a vacuum system and/or to another component (e.g. extension pole) to be used with the sanding device 1, without departing from the scope of the present invention, as can be easily understood by a person skilled in the art.

Figure 6:
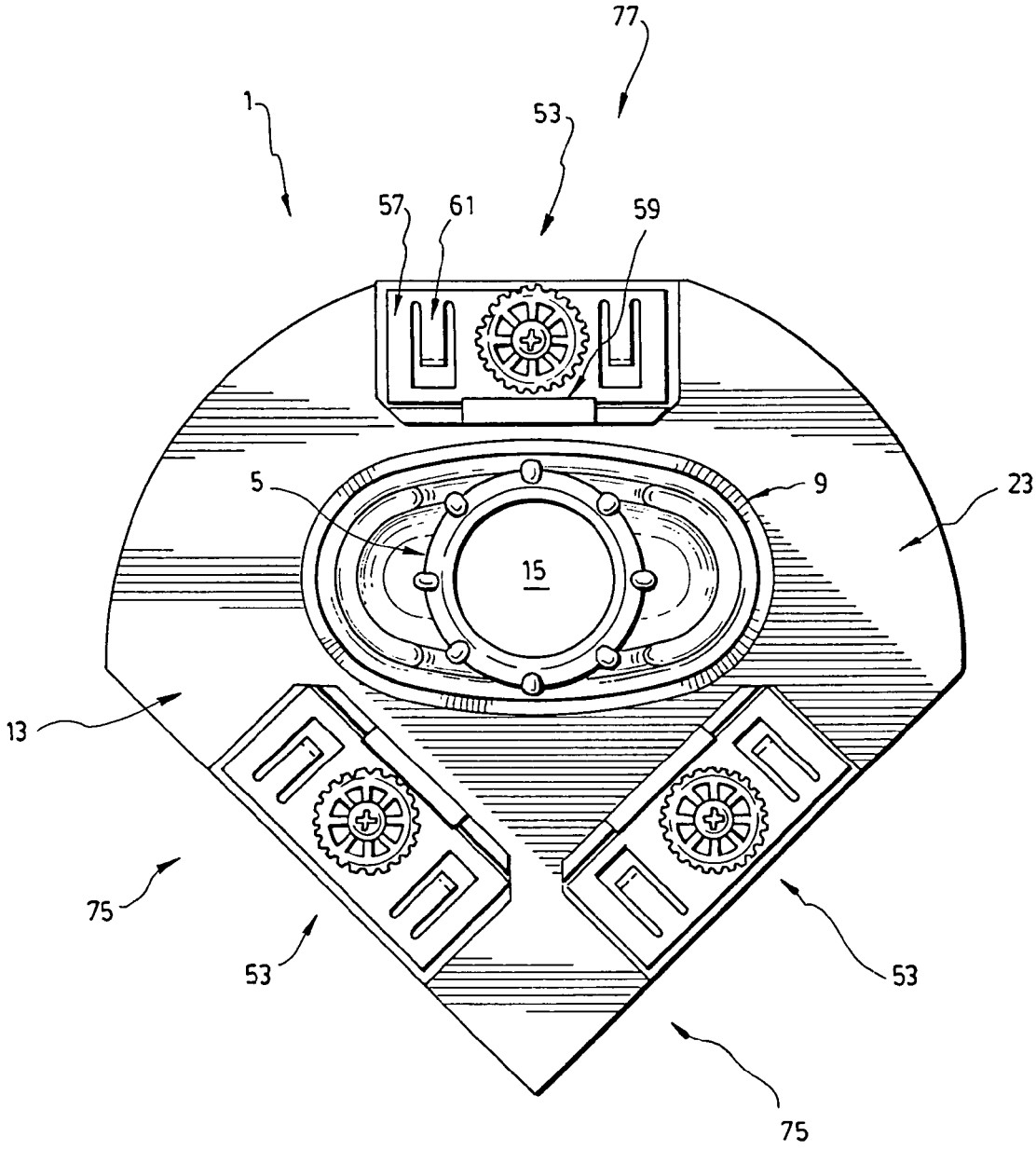
FIG. 6 is a top plan view of what is shown in FIG. 2.
Figure 7:
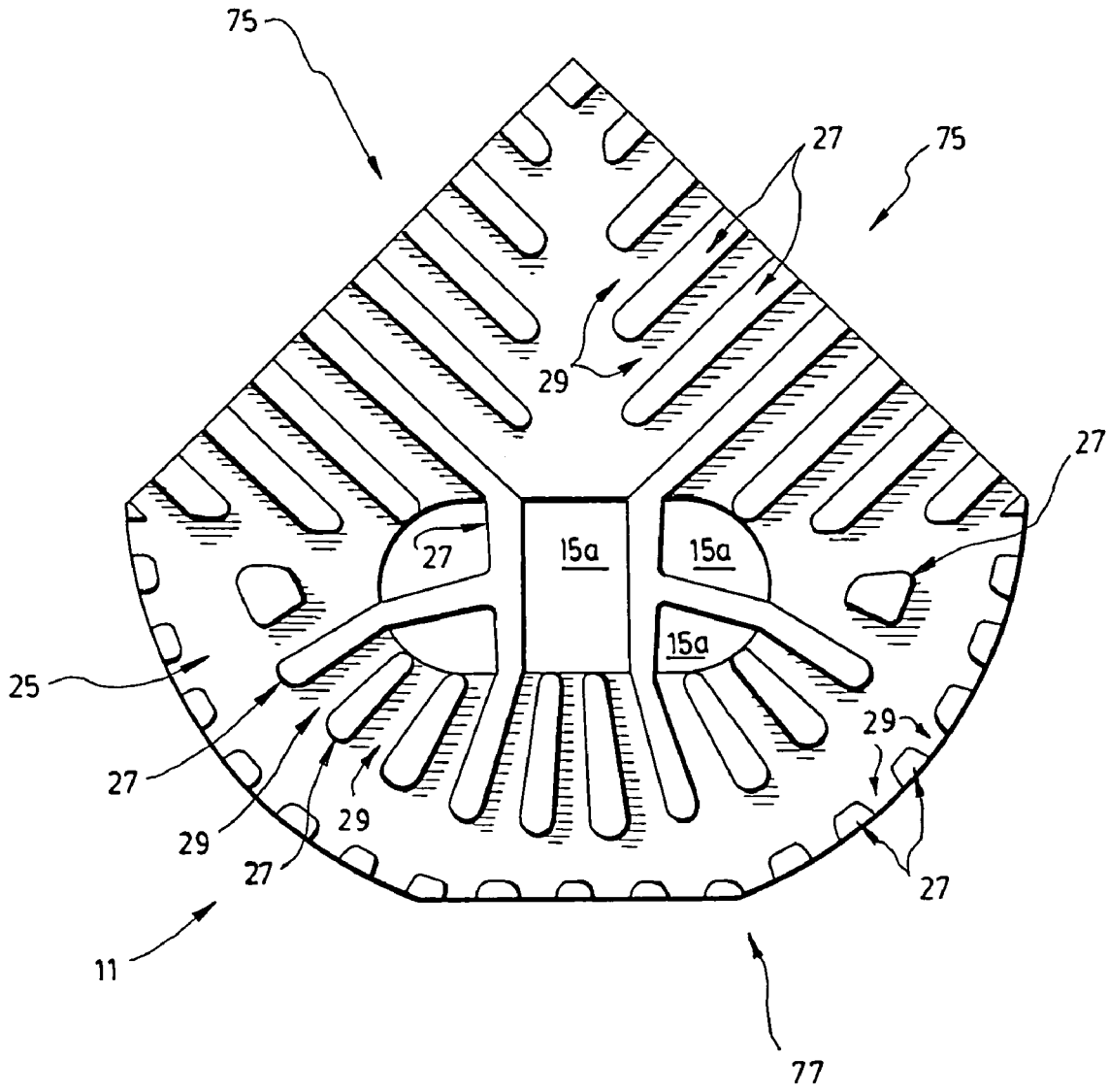
FIG. 7 is a bottom plan view of what is shown in FIG. 2.
Figure 8:
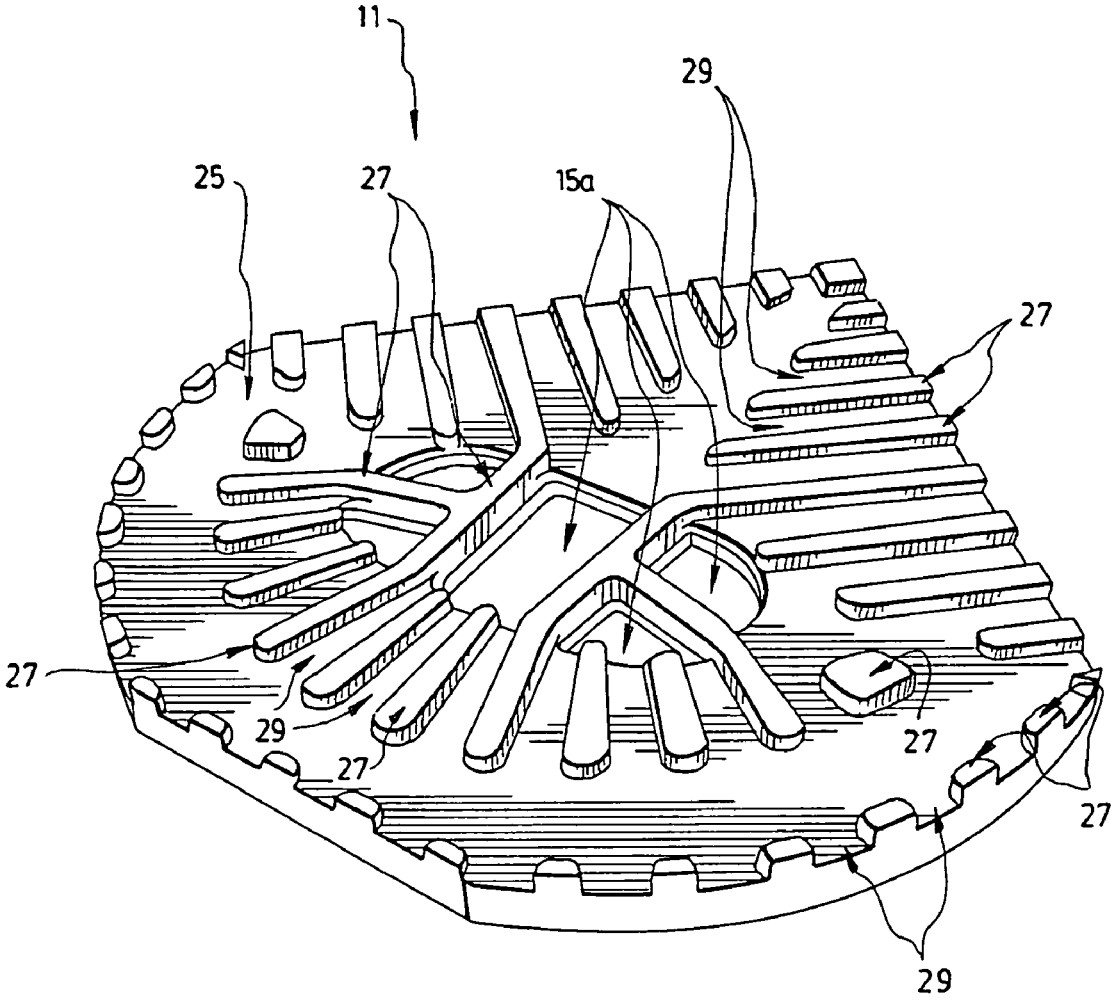
FIG. 8 is a bottom perspective view of an underlying padding of the sanding device shown in FIG. 7, according to a preferred embodiment of the present invention.

According to the preferred embodiment of the present invention, as exemplified in FIG. 1 and as better illustrated in FIG. 6, the base plate 3 comprises an angled portion having a pair of straight side edges 75, and an arched portion 77 extending between extremities of said straight side edges 75. Preferably also, the angled portion is a right-angle (about 90°) angled portion. However, once again, several other suitable shapes could be used for the base plate 3 and other corresponding components thereof without departing from the scope of the present invention, as can be easily understood by a person skilled in the art. Indeed, and for example, the base plate 3 may be rectangular, circular, or any other suitable shape, depending on the particular applications for which the sanding device 1 is intended for, and the desired end results, as apparent to a person skilled in the art.

As previously explained, the present invention essentially relates to a sanding tool with improved shape and features enabling for better, easier and more convenient sanding applications. The sanding tool preferably comprises a base plate 3 onto which several preferred components are operatively connected thereto. The base plate 3 according to the preferred embodiment of the present invention preferably comprises an angled portion, having two substantially straight sides, and an arc-shaped portion extending between extremities of said two side edges 75. The base plate 3 is preferably made of a suitable material, such as a polymeric material, composite material, and/or the like, in order to be able to properly support the various components that may be operatively connected thereto, and in order to withstand the various loads that the sanding tool may be subjected to, as apparent to a person skilled in the art. Preferably, the base plate 3 is made of styrene and/or of any suitable derivative thereof.

The padding 25 is operatively connected to a bottom portion of said base plate 3, and preferably to the support plate 23 thereof. Preferably, said padding 25 is securely affixed, via suitable adhesive or fixing means (fasteners, glue, mechanical bond, etc.), onto said bottom portion of the base plate 3. The padding 25 is preferably made of a suitable material, such as an elastomeric material, or any other suitable rubberized material, so as to advantageously be used operatively against a surface to be treated. As better shown in FIGS. 7-8, said padding 25 is preferably shaped and sized so as to define therein different channels 29 which preferably serve as evacuation channels for evacuating any particles having been sanded, into a vacuum system or the like, the latter being preferably removably affixed onto the sanding tool for providing the same with a evacuation/suction effect. An evacuation/suction effect is preferably generated from the meshing of the sanding paper, and then into said evacuating channels 29 from the padding 25, and after that towards a corresponding orifice 15 provided to that effect within a substantial centralized portion of the padding 25, as better shown in FIG. 7, so that said evacuated particles having been previously sanded can in turn be drawn into the evacuating tube 5 of the sanding tool and eventually into the apparatus providing the evacuation/suction effect, such as a commercial vacuum for example, and the like.

As can be easily understood by a person skilled in the art, the sanding paper and/or meshing preferably has a shape which is complementary to that of the padding 25 and corresponding base plate 3, and is provided with a corresponding number of tabs which are preferably used so as to removably fixed onto corresponding components of the sanding tool so as to enable an easy, quick and secure fastening of the sanding meshing onto the sanding tool. Preferably, and as better shown in FIGS. 1-6, these components comprise a securing/clamping plate which is operable between raised (i.e. "opened") and clamped ("closed") configurations, the opened configuration allowing a corresponding tab of the sanding meshing to be inserted between the clamping plate 57 and a neighboring piece, and the closed configuration consisting essentially in the clamping plate 57 clamping said tab thereinbetween. Preferably, and as better exemplified in FIG. 1, the sanding tool according to the preferred embodiment of the present invention comprises three (3) of such fastening devices 53, one on each side of the base plate 3, and these fastening devices 53 are preferably operatively mounted onto an upper portion of the base plate 3, and more particularly on the upper surface of the support plate 23, as also better shown in FIG. 1. However, it can be easily understood that the fastening devices 53 may be positioned elsewhere on the base plate 3 and/or that one single fastening device 53 may suffice, depending on the particular applications of the sanding tool for which it is intended, to properly attach the sandpaper or meshing onto the tool and carry out satisfactory sanding applications, as apparent to a person skilled in the art. Furthermore, as can be easily understood by a person skilled in the art, other suitable fastening devices 53 may be used for removably mounting the sanding meshing/paper onto, or at the very least, over, a portion of the padding 25 and/or base plate 3 of the sanding tool.

Preferably, each fastening device 53 comprises clamping means and guiding means. The clamping means are movable with respect to the upper portion of the base plate 3 between a first position where the clamping means are away from the supporting side and a second position where the clamping means rest operatively against the supporting side. The clamping means are mainly used to easily and quickly clamp a portion of the sandpaper, and more particularly, a tab thereof, against the supporting upper side of the base plate 3 and thus, may take on various other shapes and forms than the embodiments described herein. The same applies for the guiding means which are mainly used for guiding movement of the clamping means along a predetermined path between the first and second positions. In operation, a portion of the sandpaper is removably clamped between the supporting/upper side of the base plate 3 and the clamping means when the latter are in the second position.

As can be easily understood by a person skilled in the art, the fastening devices 53 each preferably comprise a pin 55 or a fastener which is preferably assembled onto the sanding tool by inserting said pin into the upper side of the base plate 3, and preferably a corresponding socket or flange thereof. Preferably also, the clamping means comprise a cam 63 and biasing means. According to the particular embodiment illustrated in the accompanying drawings, the cam 63 is preferably rotationally mounted about the pin and cooperates with the plate 57 which is preferably provided with suitable securing means so as to operate it between two configurations, the first one being used for operatively securing the cam 63 against the plate 57 so that a portion of the sandpaper is removably clamped between the cam 63 and the corresponding portion of the plate 57 by rotating the cam 63 and securing the same against the plate 57 with the securing means. Preferably also, each fastening device 53 further comprises a clamping plate 57 mounted about the pin 55 between the cam 63 and the supporting side of the base plate 3 such that the end portion of the sandpaper is removably clampable between the clamping plate 57 and the supporting side of the base plate 3 by rotating the cam 63 and securing the same against the clamping plate 57 with the securing means, as can be easily understood when referring to FIGS. 1-6.

As can be easily understood from these figures, each fastening device 53 preferably comprises at least one resilient device 61 for urging the clamping plate 57 away from the supporting side of the base plate 3 and the resilient device 61 may take on various embodiments, such as a spring for example, and the like. In the embodiment exemplified in the accompanying drawings, each resilient device 61 preferably consists of an L-shaped segment being shaped positioned and sized within the clamping plate 57 so as to urge a front portion of the clamping plate 57 away from the supporting upper side of the base plate 3, as can be easily understood when referring to FIG. 1. Although the resilient devices 61 as described herein are not essential features of the present invention, they nevertheless provide substantial advantages in that when the fastening device 53 is in the opened position, the resilient devices 61 urge the clamping plates 57 away from the supporting/upper sides of the base plate 3 so as to facilitate the insertion of a portion of the sandpaper, and more particularly the tab thereof, between the clamping plate 57 and the supporting side. Hence, a user of the sanding tool does not need to lift the clamping plate 57 from the supporting side because this action is carried out by the resilient devices 61. The use of such resilient devices 61 enables to, namely, decrease the need for the use of two hands by an operator of the tool to operate the fastening device 53 thereof. Furthermore, it is worth mentioning that other suitable components may be used for the resilient devices 61, such a cushion pad, a metallic band, or any other suitable biasing means, as can be easily understood by a person skilled in the art.

As also better shown in FIG. 1, the clamping plate 57 preferably has a rear edge in abutment with an abutment ridge 59 provided on the supporting side of the base plate 3, so that the clamping plate 57 is preferably raised in a hingedly manner when acted upon by the biasing means. This feature also further contributes to facilitating the insertion of a portion of the sandpaper between the clamping plate 57 and the supporting side.

As also better shown in FIG. 1, each fastening device 53 preferably comprises a suitable knob for operating the fastening means between the operating and closed configurations, said knob being preferably provided with the above-described cam 63, and a corresponding recess.

Referring now to FIGS. 1-6 and 9-11, the sanding tool according to the present invention preferably also comprises an evacuating tube 5 or "nozzle", which could according to a preferred embodiment of the present invention, be provided with suitable components and features, so as to enable said nozzle to be removably connected to a hose for example, of an evacuation apparatus, such as a vacuum and the like, and the inward portion of said nozzle is preferably connected to the base plate 3 in a manner so as to enable said nozzle to be displaced with respect to the base plate along a great number of degrees of freedom, as can be easily understood when referring to FIGS. 9-11. Preferably, said extremity of the nozzle is operatively connected to the base plate 3 via a suitable joint 7, such a universal joint for example, as also better illustrated in FIGS. 9-11. Furthermore, and according to a preferred embodiment of the present invention, said bottom portion of the nozzle is further provided with a suitable protective covering (i.e. sealing member 9) made of a suitable resilient and flexible material which is preferably devised to encase the front extremity of said nozzle so as to maintain an evacuation condition therein so as to facilitate the evacuation of particles being sanded with the sandpaper/meshing into the nozzle, said covering being preferably shaped and sized so as to enable the nozzle to be displaced along several directions, as aforementioned and as can be easily understood when referring to FIGS. 1 and 9-11. Said covering is preferably made of an elastic or rubberized material, or may be made of any other suitable material, enabling the above-mentioned features, resulting advantages and others, as can be easily understood by a person skilled in the art.

As may now better be appreciated, the present invention is a substantial improvement over the prior art in that, by virtue of its design and components, as explained herein, and the particular shape of the base plate thereof, the sanding tool according to the present invention enables for a quicker, easier and simpler manner than what is possible with the sanding tools available in the prior art, particularly for certain applications, such as for sanding corners, side edges and the like. Moreover, the present invention is also particularly advantageous in that it comprises fastening devices 53 which enable a quick, easy and secure manner of removably fixing sandpaper and/or meshing onto the sanding tool.

It is worth mentioning that several modifications could be made to the present sanding tool without departing from the scope of the present invention. For example, the base plate 3 and the supporting sides of the fastening devices 53 may consist of two distinct pieces, or could be devised so as to be made integral to each other, that is made of one single piece and made of one single material, as can easily be understood by a person skilled in the art. The same applies for other components and features of the present invention, and particularly in regard to the support plate 23 and underlying padding 25, which, as can be easily understood, may consist of two distinct pieces, operatively affixed to one another in a suitable manner, or may be devised so as to consist of one single piece made of one single material.

Of course, numerous modifications could be made to the above-described embodiments without departing from the scope of the present invention, as defined in the appended claims.

The invention claimed is:

1. A sanding device comprising:

a base plate having a sanding surface and an opposite supporting surface, the base plate also having an orifice extending through the base plate, from the sanding surface to the supporting surface thereof, for allowing the passage of particles sanded by the sanding surface into said orifice;

an evacuating tube having an inlet operatively connected to the supporting surface of the base pate, the inlet being positioned about the orifice of the base plate for receiving particles sanded by the sanding surface of the base plate, through the orifice thereof, the evacuating tube also having an outlet configured for operatively connecting to a vacuum system for evacuating sanded particles from the sanding surface through the orifice of the base plate via a suction effect provided by the vacuum system;

an articulated joint for operatively connecting the inlet of the evacuating tube to the supporting surface of the base plate, the articulated joint having at least one pivot axis for enabling the evacuating tube to be articulated with respect to the base plate along various operating angles; and a sealing member operatively mounted onto the base plate for sealingly interconnecting the orifice of the base plate to the inlet of the evacuating tube;

wherein the base plate comprises an angled portion having a pair of straight side edges, and an arched portion extending between extremities of said straight side edges.

2. A sanding device according to claim 1, wherein the base plate comprises a substantially rigid support plate, and an underlying padding affixed to a bottom surface of the support plate, the support plate and the underlying padding being complementary in shape to one another and defining the orifice of the base plate.

3. A sanding device according to claim 2, wherein the underlying padding has an operating surface for carrying a sanding application with the sanding device, the operating surface of the underlying padding being provided with a plurality of ribs protruding from said operating surface and defining a plurality of channels converging substantially towards the orifice of the base plate for directing sanded particles on the operating surface towards said orifice.

4. A sanding device according to claim 3, wherein at least one of said ribs extends over the orifice of the base plate in order to divide said orifice into at least one sub-orifice, and wherein the support plate and corresponding underlying padding are shaped accordingly for supporting said at least one of said ribs.

5. A sanding device according to claim 2, wherein the support plate is made of an elastomeric material, and wherein the underlying padding is made of a rubber material.

6. A sanding device according to claim 2, wherein the support plate of the base plate is provided with a rim projecting from an upper surface of said support plate and extending about a periphery of the orifice of the base plate, the rim comprising a pair of opposite supports for supporting a first hinge of the articulated joint, said first hinge being rigidly connected to the inlet of the evacuating tube and being pivotable with respect to said supports of the rim along a first pivot axis.

7. A sanding device according to claim 6, wherein the first hinge of the articulated joint comprises a support for supporting a second hinge of the articulated joint, said second hinge being pivotable with respect to said supports of the first hinge along a second pivot axis.

8. A sanding device according to claim 6, wherein the sealing member has a first end securely mounted about the rim of the support plate and a second end securely mounted about a first peripheral portion of the evacuating tube, adjacent to the inlet thereof.

9. A sanding device according to claim 8, wherein a second peripheral portion of the evacuating tube, adjacent to the first peripheral portion thereof, is provided with a peripheral groove for receiving a ring with stoppers for abutting against the second end of the sealing member.

10. A sanding device according to claim 2, wherein the support plate has a peripheral surface provided with at least one fastening device for removably clamping at least one corresponding tab of a sanding meshing extendable over the operating surface of the underlying padding of the base plate.

11. A sanding device according to claim 10, wherein each fastening device comprises a pin projecting from an upper surface of the support plate, and a clamping plate mounted about said pin, the clamping plate having a rear edge nested within an abutment ridge and a front edge operable between raised and clamping configuration, the clamping plate being provided with a resilient device for biasing the clamping plate into the raised configuration, and being further provided with a securing cam mounted about the pin and cooperable with an embossment of said pin for selectively securing the clamping plate into the clamping configuration via a rotation of the securing cam.

12. A sanding device according to claim 1, wherein the outlet of the evacuating tube comprises an end shaped and sized for receiving a hose of the vacuum system, said end being provided with longitudinal slits for defining a plurality of choking tongues, and wherein the sanding device further comprises a choking collar displaceable about the choking tongues so as to adjustably secure said choking tongues against the hose of the vacuum system when inserted into the end of the outlet of the evacuating tube.

13. A sanding device according to claim 12, wherein the choking tongues are provided with outer threading complementary to inner threading of the choking collar so that a rotation of the collar about the end of the evacuating tube displaces the choking collar along the same for adjustably constricting the choking tongues against one another.

14. A sanding device according to claim 1, wherein the angled portion is a right-angle angled portion.

15. A sanding device according to claim 1, wherein the sanding device is provided with a sanding meshing extending over the sanding surface of the base plate.

16. A sanding device comprising:

a base pate having a sanding surface and an opposite supporting surface, the base plate also having an orifice extending through the base plate, from the sanding surface to the supporting surface thereof, for allowing the passage of particles sanded by the sanding surface into said orifice;

an evacuating tube having an inlet operatively connected to the supporting surface of the base pate, the inlet being positioned about the orifice of the base plate for receiving particles sanded by the sanding surface of the base plate, through the orifice thereof, the evacuating tube also having an outlet configured for operatively connecting to a vacuum system for evacuating sanded particles from the sanding surface through the orifice of the base plate via a suction effect provided by the vacuum system;

an articulated joint for operatively connecting the inlet of the evacuating tube to the supporting surface of the base plate, the articulated joint having at least one pivot axis for enabling the evacuating tube to be articulated with respect to the base plate along various operating angles; and a sealing member operatively mounted onto the base plate for encasing the articulated joint and for sealingly interconnecting the orifice of the base plate to the inlet of the evacuating tube;

wherein the base plate comprises a substantially rigid support plate, and an underlying padding affixed to a bottom surface of the support plate, the support plate and the underlying padding being complementary in shape to one another and defining the orifice of the base plate;

wherein the underlying padding has an operating surface for carrying a sanding application with the sanding device, the operating surface of the underlying padding being provided with a plurality of ribs protruding from said operating surface and defining a plurality of channels converging substantially towards the orifice of the base plate for directing sanded particles on the operating surface towards said orifice;

wherein at least one of said ribs extends over the orifice of the base plate in order to divide said orifice into at least one sub-orifice, and wherein the support plate and corresponding underlying padding are shaped accordingly for supporting said at least one of said ribs;

wherein the support plate of the base plate is provided with a rim projecting from an upper surface of said support plate and extending about a periphery of the orifice of the base plate, the rim comprising a pair of opposite supports for supporting a first hinge of the articulated joint, said first hinge being rigidly connected to the inlet of the evacuating tube and being pivotable with respect to said supports of the rim along a first pivot axis;

wherein the first hinge of the articulated joint comprises a support for supporting a second hinge of the articulated joint, said second hinge being pivotable with respect to said supports of the first hinge along a second pivot axis;

wherein the sealing member has a first end securely mounted about the rim of the support plate and a second end securely mounted about a first peripheral portion of the evacuating tube, adjacent to the inlet thereof;

wherein a second peripheral portion of the evacuating tube, adjacent to the first peripheral portion thereof, is provided with a peripheral groove for receiving a ring with stoppers for abutting against the second end of the sealing member;

wherein the support plate has a peripheral surface provided with at least one fastening device for removably clamping at least one corresponding tab of a sanding meshing extendable over the operating surface of the underlying padding of the base plate;

wherein each fastening device comprises a pin projecting from an upper surface of the support plate, and a clamping plate mounted about said pin, the clamping plate having a rear edge nested within an abutment ridge and a front edge operable between raised and clamping configuration, the clamping plate being provided with a resilient device for biasing the clamping plate into the raised configuration, and being further provided with a securing cam mounted about the pin and cooperable with an embossment of said pin for selectively securing the clamping plate into the clamping configuration via a rotation of the securing cam;

wherein the outlet of the evacuating tube comprises an end shaped and sized for receiving a hose of the vacuum system, said end being provided with longitudinal slits for defining a plurality of choking tongues, and wherein the sanding device further comprises a choking collar displaceable about the choking tongues so as to adjustably secure said choking tongues against the hose of the vacuum system when inserted into the end of the outlet of the evacuating tube;

wherein the choking tongues are provided with outer threading complementary to inner threading of the choking collar so that a rotation of the collar about the end of the evacuating tube displaces the choking collar along the same for adjustably constricting the choking tongues against one another;

wherein the base plate comprises an angled portion having a pair of straight side edges, and an arched portion extending between extremities of said straight side edges; and wherein the articulated joint is a universal joint.

17. A sanding assembly for sanding and evacuating particles, the sanding assembly comprising:

a vacuum system; and sanding device, the sanding device comprising:

a base plate having a sanding surface and an opposite supporting surface, the base plate also having an orifice extending through the base plate, from the sanding surface to the supporting surface thereof, for allowing the passage of particles sanded by the sanding surface into said orifice;

an evacuating tube having an inlet operatively connected to the supporting surface of the base pate, the inlet being positioned about the orifice of the base plate for receiving particles sanded by the sanding surface of the base plate, through the orifice thereof, the evacuating tube also having an outlet connected to the vacuum system for evacuating sanded particles from the sanding surface through the orifice of the base plate via a suction effect provided by the vacuum system;

an articulated joint for operatively connecting the inlet of the evacuating tube to the supporting surface of the base plate, the articulated joint having at least one pivot axis for enabling the evacuating tube to be articulated with respect to the base plate along various operating angles; and a sealing member operatively mounted onto the base plate for sealingly interconnecting the orifice of the base plate to the inlet of the evacuating tube so as to increase thereinbetween the suction effect provided by the vacuum system;

wherein the base plate comprises an angled portion having a pair of straight side edges, and an arched portion extending between extremities of said straight side edges.

* * * * *